US005092369A

United States Patent [19]

Derudder

[11] Patent Number: 5,092,369

[45] Date of Patent: Mar. 3, 1992

[54] HOOK SELECTION DEVICE IN AN ELECTRONICALLY CONTROLLED JACQUARD MACHINE

[75] Inventor: Carlos Derudder, Heule, Belgium

[73] Assignee: N.V. Michel Van de Wiele, Kortrijk-Marke, Belgium

[21] Appl. No.: 550,895

[22] Filed: Jul. 11, 1990

[30] Foreign Application Priority Data

Jul. 14, 1989 [BE] Belgium ..... 08900769

[51] Int. Cl.[5] ..... D03C 3/00

[52] U.S. Cl. ..... 139/65

[58] Field of Search ..... 139/56, 65, 63

[56] References Cited

U.S. PATENT DOCUMENTS 2,675,833 4/1954 Foster ..... 139/65
4,022,251 5/1977 Bucher ..... 139/65 X
4,739,806 4/1988 Palau et al. ..... 139/65 X

FOREIGN PATENT DOCUMENTS 2587045 3/1987 France .

*Primary Examiner*—Andrew M. Falik
*Attorney, Agent, or Firm*—James Creighton Wray

[57] ABSTRACT

Device comprising a structure disposed above the knives of an electronically controlled Jacquard machine such that on the upward movement of the knives the hooks moving with them carry along at least one part of the structure. As a result, during the dropping of the knives the downward retracting force acting upon thw hooks is increased by the weight carried along. A preferred embodiment is an auxiliary grid comprising a number of horizontal auxiliary grid bars fixed parallel and adjacent to each other in a frame. Each of said bars lie parallel along the direction of movement of a knife and just above it, in such a way that a hook moving up with the knife raises the grid with its hook nose. The grid is supported and guided by various mechanisms.

12 Claims, 2 Drawing Sheets

HOOK SELECTION DEVICE IN AN ELECTRONICALLY CONTROLLED JACQUARD MACHINE

BACKGROUND OF THE INVENTION

It is known that in an electronically controlled Jacquard machine the selection of a hook takes place by means of an electromagnet which is energized and attracts the flat spring hook at the moment at which the latter is raised by the underlying knife. During the attraction of said hook against the electromagnet housing a latch on the electromagnet housing passes through a slot in the hook. During the return of the knife a retracting spring, connected to the hook via the harness cord, ensures that this hook is drawn downwards. If it is selected, it is hooked firmly with its slot onto the latch on the electromagnet housing and thus remains up, which is the purpose of the selection of a hook. If the hook is not selected, it follows the return movement of the knife.

If now, as a result of too high tension in a warp end, the retracting spring of the harness cord, as a result of the friction is not able to pull the hook down, the latter does not become suspended from the latch on the electromagnet. The result of this is that faults occur in the fabric, due to the fact that restoration of the selection does not take place because the harness retracting spring is no longer supplying the required adjusting effort to the hook. The object of the invention is to provide a solution to this problem.

SUMMARY OF THE INVENTION

The subject of the invention is a device for improving the hook selection in an electronically controlled Jacquard machine, characterized in that it comprises an auxiliary grid which is composed of a number (corresponding to the number of rows of hooks) of individual horizontal bars lying parallel and adjacent to each other and fixed in a frame, said frame being fixed on the electronically controlled Jacquard machine above the knives, so that each bar stands parallel to the direction of movement of a knife, and in which two rows of flat hooks between two bars always project above the auxiliary grid, at such a height above the knives that the hooks, which with the hook noses are carried along by the knives in an upward movement, in turn at the end of said lifting movement with the same hook noses carry along the bar situated above their row, and also the frame in which the bar is clamped, the weight of said carried parts on the downward movement of the knives being sufficient to pull down the hook(s) whose retracting force has been lost, which in the case of a selection of a hook results in a faultness hooking thereof onto the latch on the electromagnet housing, as a result of which a correct selection remains guaranteed in all situations.

Further characteristics and advantages of this device for improving the selection of the hooks in an electronically controlled Jacquard machine according to the invention will emerge from the description which follows of a specific embodiment thereof, but the invention is not limited to this possible embodiment. This description is illustrated by the appended figures.

DETAILED DESCRIPTION OF THE DRAWINGS

Figure 1:
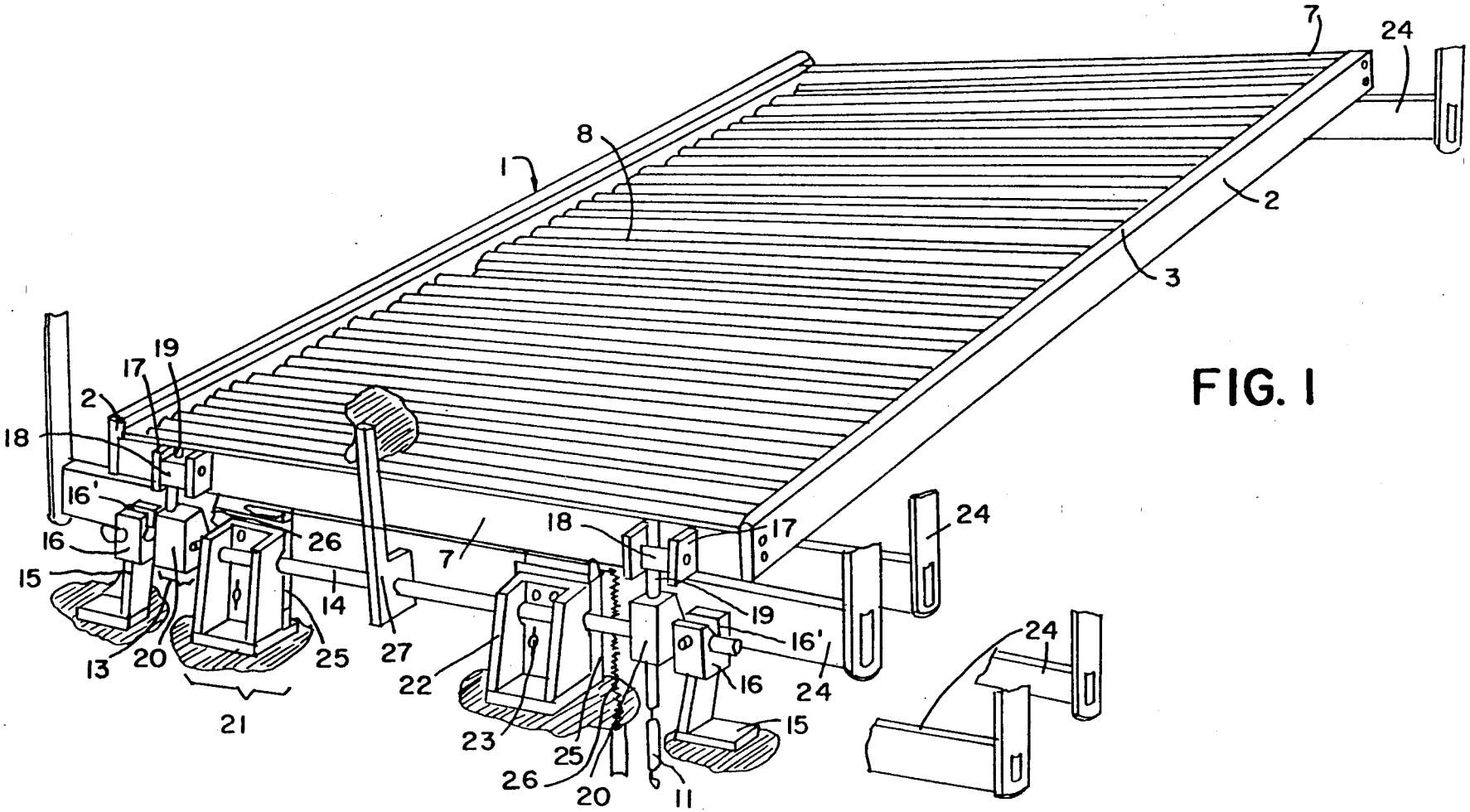
FIG. 1 shows a prespective drawing of a preferred embodiment of the device according to the invention.
Figure 3:
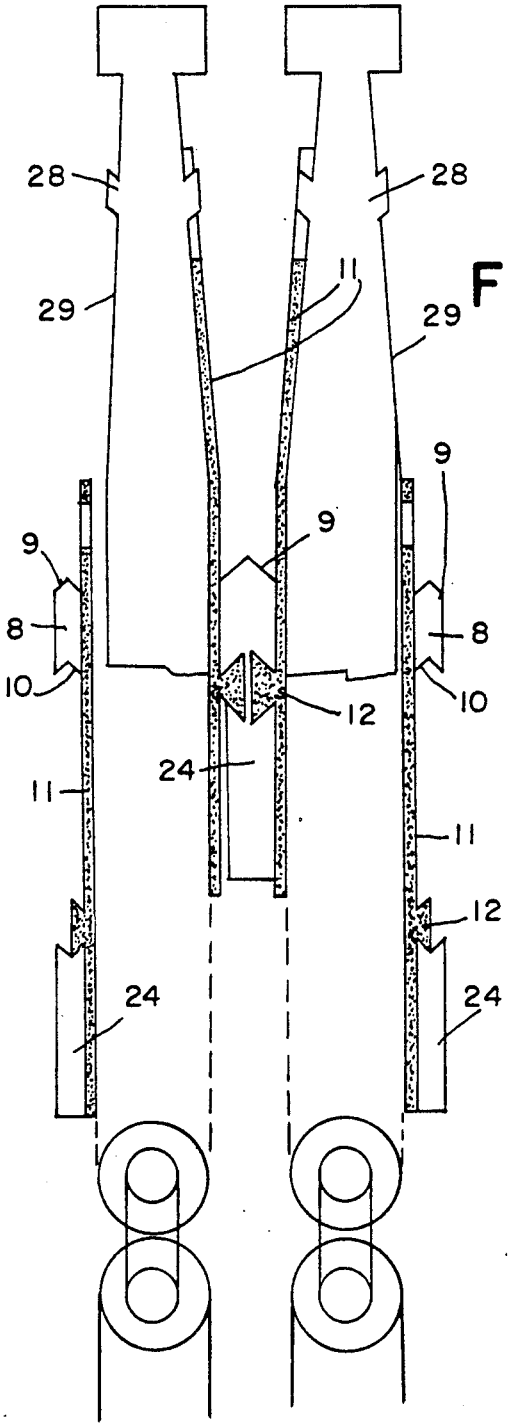
FIG. 3 shows a detail drawing in side view of two electromagnet holders, each with its two hooks, and the interacting knives and auxiliary grid bars, in a number of different situations (from left to right; knife with its hook and auxiliary grid bar down; enlarged view of the knife with two of its hooks and auxiliary grid bar up, one of the hooks having been selected, knife with its hook and auxiliary grid bar down).
Figure 2:
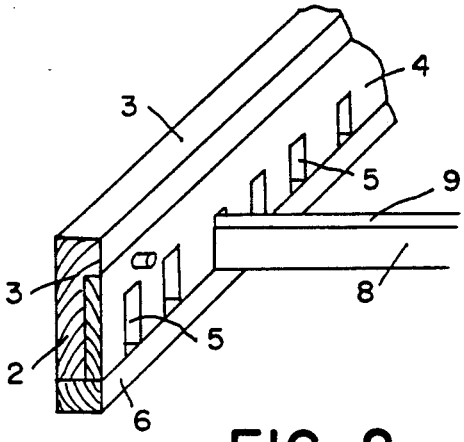
FIG. 2 shows a perspective drawing of a part of the auxiliary grid, with an indication of the component parts of the frame, in which the auxiliary grid bars are clamped.

The device described according to the invention comprises a rectangular frame (1), the two longest sides of which comprise two bar-shaped supporting beams (2), which are placed with the narrowest sides horizontal, and which are provided with a vertical rectangular recess over the entire length of the vertical side of the beam (2), along the inside of the frame (1), said recess being such that a broader top edge (3) is produced on each beam (2), and the beam (2) below said edge (3) going downwards over the entire remaining height is narrower than said edge (3).

The device according to the invention is also characterized in that a distribution board (4) is provided in the above-mentioned recess of each beam (2), over the entire length thereof, said board having the same dimensions as said recess, and being places in such a way that it fills said recess, and is fixed in that way by means of bolts and nuts, screws or some other fixing device, while rectangular vertical slots (5) are provided at regular intervals from each other over the entire length of said distribution board (4), running from the bottom side of said distribution board (4), said slots (5) not reaching through to the top edge.

The device according to the invention described above is also characterized in that a closing plate (6) of the same width as the beam (2) with its recesses filled by the distribution board (4) is fixed by means of bolts and nuts, screws or any other fixing device against the bottom side of the beam (2) and the distribution board (4), over the entire length thereof, so that the open sides of the slots (5) are shut off by it.

The device described according to the invention is further characterized in that the two, normally shortest, sides of the rectangular frame (1) comprise two cross bars or boards (7) with rectangular profile which are placed with their narrowest sides horizontal, their height being equal to the height of the above-mentioned recess in the beam (2), in such a way that the ends of said cross bars (7) connecting to the beams (2) with a right angle fit into said recess under the edge (3), and in that the bottom sides of the two beams (2) and the two cross bars (7) come to lie in the same plane.

The device according to the invention is also characterized in that the slots (5) situated in the distribution board (4) are positioned in pairs directly opposite each other, according to virtual connecting lines which are parallel to each other and to the cross bars (7) forming the shortest sides of the rectangular frame (1). Every two directly opposite slots (5) have in them the ends of an auxiliary grid bar (8), and the ends of said auxiliary grid bars (8) have to be slid into the slots (5) along their open side and just fit into them, before the closing plate (6) is fixed, and are clamped in said slots (5) through the fixing of said closing plate (6).

The device described, according to the invention, is also characterized in that the cross-section of the auxiliary grid bars (8) is a polygon, of which both the top part (9) and the bottom part (10) assume the shape of an inverted V, the shape of said cross-section being retained over the entire length of the bars (8).

The device according to the invention also comprises a series of flat spring hooks (11), which are each provided with hook noses (12) in order to permit taking-up the hook (11) by the knife (24) situated below it during the rise movement. These hook noses (12) are characterized in that along the top they are of a shape which is complementary to the nearest flank of the bottom side of the auxiliary grid bars (8), which is profiled like an inverted V, so that during the upward movement of the hook (11) said hook nose (12) on each hook (11) becomes hooked in the bottom side (10) of the auxiliary grid bar (8) lying above it, and in this way gently raises the auxiliary grid bar (8), and the parts connected thereto, to its top position. The bottom side of said hook nose (12) on each hook (11) is complementary to the nearest flank of the top side of each knife (24), which over its entire length at the top has a cross-section in the shape of an upright V, in order to allow each hook (11) to be carried along by the knife (24) lying below it during its upward movement. The hook nose (12) on each hook (11) is consequently designed in the form of a dovetail, in side view.

The device described, according to the invention, also comprises four mechanisms (13) for guiding the auxiliary grid which are fixed against the boards (7) forming the transverse sides of the rectangular frame (1), symmetrically relative to the axis of symmetry in the lengthwise direction of said frame (1), and two mechanisms per board (7), parts of each pair of mechanisms (13) situated opposite one board (7) of the frame (1) also being mounted on a shaft (14) which is supported by two supports (15) and is clamped by means of a clamping blocks (16). Each mechanism (13) in this case comprises a holder (17) fixed to board (7), in which block (18) is placed in such a way that it is rotatable about a horizontal axis. Block (18) contains a vertical bore through which a vertical pin (19) is sliding. Pin (19) is fixed to a block (20) which is fixed to the shaft (14). The two shafts (14) are situated below the boards (7) of the rectangular frame in such a way that the four pins (19) of the blocks (20) connected to the shafts can be positioned vertically through the bores in the guide pieces (17) which are fixed on the boards (7). The shafts (14) are holded by clamping blocks (16) provided with slitted bores (16'), so that one end of the shaft (14) can be situated in a broader cylindrical-shaped part of said slitted bores (16'), while said slitted bores (16') can be narrowed by means of a screw or similar device, so that the shaft (14) can no longer turn, and can be widened again if it is necessary for the shaft to be able to turn, said clamping blocks (16) being positioned on L-shaped supports (15) which are fixed by their horizontal part on the electronically controlled Jacquard machine.

The device described, according to the invention, also comprises four supporting elements (21) which are placed symmetrically relative to the frame (1) below the cross bars (7), and said supporting elements (21) are situated in pairs opposite the same shaft (14) which they enclose, each supporting element (21) being made up of a hollow bar-shaped structure (22) of which the front and the top face are missing, and having in the two side walls, just before the rear wall a bore to allow the shaft (14) horizontally through the structure (22), and having in the bottom wall bores which are provided in order to fix the structure (22) on a horizontal plane of the Jacquard machine by means of bolts and nuts, screws or any other fixing device, and having slots (23) which are provided in the rear wall of the structure (22), while, interacting in these slots (23), shock-absorbing contact pieces (25) are fixed against the rear side of the bar-shaped structure (23), said contact pieces describing a flat bar shape and being adjustable in height while sliding in the slots (23).

The device described, according to the invention, is further characterized in that the fixing of the device and the height regulation of the shock-absorbing contact pieces (25) are such that the two cross bars (7) of the rectangular frame (1) each rest on two shock-absorbing contact pieces (25) as seen in FIG. 1 (if the frame (1) is not carried along by a hook), while the pins (19) are sliding through the bores in the guide pieces (17), and each shaft (14) is through the apertures in the side walls of two bar-shaped structures (22).

The device described, according to the invention, also comprises four springs (26) which are placed in pairs relative to the cross bars (7) of the rectangular frame (1), symmetrical relative to the axis of symmetry in the lengthwise direction of said frame (1). These springs are connected at one side to the frame (1) and at the other side running vertically downwards are fixed to the Jacquard machine, so that the auxiliary grid during an upward movement undergoes spring loading which can be regulated by means of a screw (26') or similar device which through turning determines the expansion of the spring, and thus its spring force.

The device described, according to the invention, is further characterized in that fixed in the center of each shaft (14) is a lever (27) which makes it possible to shift the auxiliary grid forwards and backwards in depth, through the fact that said lever (27) allows shaft (14), to turn after clamping system (16) is released, which shaft then moves the grid (1) forwards or backwards by means of the pins (19). It is necessary to make room for the removal or insertion of a hook (11). The lever arm (27) can also be fixed to the Jacquard machine by means of a screw or any other fixing device, so that the lever remains in its vertical position.

The device described, according to the invention, is such that all the hooks are situated between the bars (8), in the spaces between provided for them, while the hooks, interacting with one knife lying below them, are situated on either side of the same bars (8), and the auxiliary grid is above the knives (24), at such a height that a hook (11) carried along by a knife (24) at the end of its upward movement with the top side of the hook nose (12) carries along the auxiliary grid bar (8) lying above it, and consequently the complete auxiliary grid.

The way in which the device according to the invention functions, and also the advantage thereof, is that when a hook (11) is raised by a knife (24) the weight of the auxiliary grid carried along by said hook (11) via bar (8) ensures that on the return downward movement of the knives (24) the hooks (11) are drawn downwards with certainly, so that on selection they hook onto the hook-shaped projection or latch (28) on the electromagnetic housing (29) or if not selected move back downwards with the knives (24), the certainty of the restoration of the selection forming the advantage of the device according to the invention relative to the existing electronically controlled Jacquard machines.

While the invention has been described with reference to specific embodiments, modifications and variations of the invention may be constructed without departing from the scope of the invention, which is described in the following claims.

I claim:

1. A device for hook selection in an electronically controlled Jacquard machine, wherein a structure is disposed above plural knives and interacts with the hooks in such a way that on an upward movement of the knives and of the hooks moving with them at least one of plural parts of said structure is carried along by said hooks from a mechanism for supporting said parts, and in that through the weight of said parts carried along by the hooks a downward retracting force which is exerted on plural springs during a downward movement of the knives and the hooks is increased sufficiently to hook the selected hooks on a latch from plural electromagnet housings.

2. The device as claimed in claim 1, wherein the parts of the structure which can be carried along by the hooks are provided with at least one mechanism for guiding each of said parts during their upward and downward movement.

3. The device as claimed in claim 1, wherein the parts of the structure which can be carried along by the hooks are also connected by means of at least one spring means to the Jacquard machine, in such a way that they are loaded by a downward directed spring load, the spring force being variable by a control screw means.

4. The device as claimed in claim 1, wherein the said structure comprises an auxiliary grid which is composed of as many individual horizontal auxiliary grid bars as there are knives, said grid bars lying parallel and adjacent to each other and fixed in a frame, said frame being fixed in such a way that each auxiliary grid bar stands parallel to the direction of movement of a knife above said knife, and wherein the hooks interacting in pairs with a particular knife are situated on either side of the same auxiliary grid bar and project above it, and wherein these hooks when they are raised by the knife with their hook nose, via the auxiliary grid bar lying above, carry the auxiliary grid up with them at the end of said lifting movement.

5. The device as claimed in claim 4, wherein the auxiliary grid comprises a rectangular frame, the two longest sides of which comprise two beams, each of which is provided with a recess running over the entire length, while distribution boards fitting into said recesses are fixed to said beams, filling up the recesses over their entire length, said distribution boards being provided over their entire length at regular intervals from each other with vertical slots which run from the bottom sides of said distribution boards and not through to the top, and said slots lying in the opposite sides, in pairs opposite each other along connecting lines which are parallel to each other and to the boards forming the shortest sides of the rectangular frame, and closing plates being fixed over their entire length against the bottom sides of the bearing sections with distribution boards fixed thereto, said plates being of the same width as the above-mentioned bottom sides, in such a way that the open sides of the vertical slots are shut off by them towards the bottom.

6. The device as claimed in claim 4, wherein each hook is provided with a hook nose which in side view is a dovetail shape.

7. The device as claimed in claim 5, wherein every two directly opposite slots contain the ends of an auxiliary grid bar which fit closely therein by sliding them in along the open sides of the vertical slots at the bottom, before the closing plates are fixed, and which are clamped fast in said slots through the fixing of said closing plates.

8. The device as claimed in any of claims 4 to 7, wherein the auxiliary grid bars along a transverse section are in the shape of a polygon, of which both the top and the bottom part is the shape of an inverted V, this shape being maintained over the entire length of the auxiliary grid bars.

9. The device as claimed in claim 4, wherein it is equipped with four mechanisms for guiding the auxiliary grid, comprising four holders fixed in a symmetrical manner against the two transverse sides of the frame, provided with bores running vertically and containing pins which are situated slidably in said bores and are fixed in pairs on two horizontal shafts located below the auxiliary grid, parallel to the transverse sides of the frame, each of said shafts being supported at their ends by means of L-shaped supports which are fixed on the Jacquard machine, while the shaft ends are situated in slitted bores of clamping systems forming part of the supports, in which case the turning of the shafts can be made possible or impossible by narrowing or widening said slitted bores by means of a screw or similar device.

10. The device as claimed in claim 9, wherein it is equipped with four mechanisms for supporting the auxiliary grid, which are disposed symmetrically relative to said auxiliary grid and comprise the horizontal shafts below the auxiliary grid, and each of which comprises a hollow bar-shaped structure of which the front and top face is missing, with bores running horizontally through two side walls to allow the horizontal shafts through, and bores in the bottom side which are used for fixing on a horizontal plane of the Jacquard machine, and with slots in a rear wall in which shock-absorbing supporting pieces in the form of a flat beam, and adjustable in height, are fixed, so that they support the sides of the frame lying above them.

11. The device as claimed in claim 9, in which provision is made on at least one horizontal shaft below the auxiliary grid for a lever which allows the above-mentioned shaft to turn, the lever arm being fixed in the vertical position on the Jacquard machine by means of a screw means.

12. An electronically controlled Jacquard machine, provided with a device for hook selection, wherein a structure is disposed above plural knives and interacts with the hooks in such a way that on an upward movement of the knives and of the hooks moving with them at least one of plural parts of said structure is carried along by said hooks from a mechanism for supporting said parts, and in that through the weight of said parts carried along by the hooks a downward retracting force which is exerted on plural springs during a downward movement of the knives and the hooks is increased sufficiently to hook the selected hooks on a latch from plural electromagnet housings.

* * * * *